US005081387A

United States Patent [19]

Nystuen

[11] Patent Number: 5,081,387

[45] Date of Patent: Jan. 14, 1992

[54] PUMP MOTOR/BASKET BRAKE FOR AN AUTOMATIC WASHER

[75] Inventor: Arne M. Nystuen, Lincoln Township, Berrien County, Mich.

[73] Assignee: Whirlpool Corporation, Benton Harbor, Mich.

[21] Appl. No.: 512,515

[22] Filed: Apr. 19, 1990

Related U.S. Application Data

[60] Continuation of Ser. No. 268,982, Nov. 9, 1988, abandoned, which is a division of Ser. No. 137,601, Dec. 24, 1987, Pat. No. 4,802,347.

[51] Int. Cl.[5] ..... H02K 1/00

[52] U.S. Cl. ..... 310/191; 310/66; 310/77; 310/254; 181/161; 181/162

[58] Field of Search ..... 310/191, 192, 209, 116, 310/117, 40 MM, 254, 255, 190, 259, 193, 75 A, 76, 77, 78, 92, 93, 100, 112, 108, 66, 48, 114, 261; 188/161, 162; 336/132, 134, 135

[56] References Cited

U.S. PATENT DOCUMENTS

| | | | |
|---|---|---|---|
| 672,419 | 4/1901 | Johnson | 310/191 |
| 1,818,330 | 8/1931 | Horni | 310/163 |
| 1,895,049 | 1/1933 | Rosenberg | 310/191 |
| 2,591,510 | 4/1952 | Clark . | |
| 2,694,781 | 11/1954 | Hinz . | |
| 3,184,933 | 5/1965 | Gaugler . | |
| 3,970,907 | 6/1976 | Meyers . | |
| 4,205,244 | 5/1980 | Fukushima | 310/40 MM |
| 4,324,992 | 4/1982 | Paratte | 310/49 R |
| 4,375,587 | 3/1988 | Perl . | |
| 4,428,313 | 1/1984 | Takiguch | 310/36 |
| 4,623,811 | 11/1986 | Nystuen | 310/192 |
| 4,675,566 | 6/1987 | Nystuen | 310/254 |
| 4,802,347 | 2/1989 | Nystuen | 310/117 |

FOREIGN PATENT DOCUMENTS

| | | | |
|---|---|---|---|
| 0665553 | 9/1938 | Fed. Rep. of Germany | 310/191 |
| 0757515 | 10/1944 | Fed. Rep. of Germany | 310/191 |
| 0853307 | 10/1952 | Fed. Rep. of Germany | 310/191 |
| 0526510 | 5/1955 | Italy | 310/191 |
| 0403518 | 12/1933 | United Kingdom | 310/191 |

*Primary Examiner*—R. Skudy

*Attorney, Agent, or Firm*—Hill, Van Santen, Steadman & Simpson

[57] ABSTRACT

An automatic washer is provided with a separate motor to drive the drain pump, the motor having a displaceable stator portion connected to the basket brake mechanism such that when the pump motor is energized the basket brake will be released. Such a construction obviates the need for a separate component such as a solenoid to deactivate the brake mechanism. The stator portion is displaceable perpendicularly to the rotor axis and can move either in a radial sliding manner or can be pivotally mounted so as to move through an arc relative to the rotor.

10 Claims, 2 Drawing Sheets

PUMP MOTOR/BASKET BRAKE FOR AN AUTOMATIC WASHER

This is a continuation of application Ser. No. 268,982, filed Nov. 9, 1988, now abandoned.

This is a division of application Ser. No. 137,601, filed Dec. 24, 1987, now U.S. Pat. No. 4,802,347.

BACKGROUND OF THE INVENTION

1. Field of the Invention

The present invention relates to automatic washers and more particularly to an improved arrangement for activating a basket brake for an automatic washer.

2. Description of the Prior Art

In automatic washers it is standard practice to apply a brake to the wash basket during certain periods of a wash cycle, such as during an agitate mode so that the basket is held stationary relative to an oscillating agitator. At other times in the wash cycle it is desirable to permit the basket to rotate, such as during a period while wash liquid is being pumped from the basket, such as during a spin dry mode.

To operate the brake which oftentimes is in the form of a band surrounding a hub which rotates with the basket, a solenoid is used wherein the brake band is generally biased into an engaging position when the solenoid is off, so that in the event of a power outage this results in the brake being on. The solenoid overcomes the spring bias and moves the brake band into an off or release position.

A solenoid is a fairly expensive electrical component and it would be advantageous if the brake could be controlled without resort to the use of this separate component.

U.S. Pat. No. 4,375,587 discloses a motor having either an axially displaceable rotor or an axially displaceable pole piece, both of which are caused to move by magnetic attraction when the motor is energized to accuate a switch. Other patents disclosing axially displaceable rotors include U.S. Pat. Nos. 2,591,510; 3,184,933 and 2,694,781.

SUMMARY OF THE INVENTION

The present invention provides an improved motor construction which, in one embodiment of use provides a means for activating and deactivating a band brake for an automatic washer which obviates the need for a separate electrical component such as a solenoid to operate the brake.

The improved motor construction provides that a portion of the field or stator of the motor be displaceable relative to the rotor in either a sliding or pivotable manner. This portion of the stator is normally biased into the displaced position, but upon energization of the motor the attractive magnetic forces overcome the displacing bias and draw the stator into close proximity to the rotor. A linkage is provided between the displaceable stator and the brake band so that displacement of the stator toward the rotor disengages the brake.

In automatic washers it is desirable to release the basket from restraint against rotation when a pump is pumping water from the washing machine, but at all other times it is desirable to have the basket restrained against rotation. Therefore, a separate motor having a displaceable stator can be provided for the pump to discharge water from the washing machine and, when this separate motor is activated, the basket brake will be disengaged. At all other times the brake will be biased into engagement therefore preventing rotation of the basket.

It will be appreciated that the present invention of a displaceable stator has utility and applications other than use in an automatic washer although the invention has particular utility in such an arrangement.

DESCRIPTION OF THE PREFERRED EMBODIMENT

Figure 1:
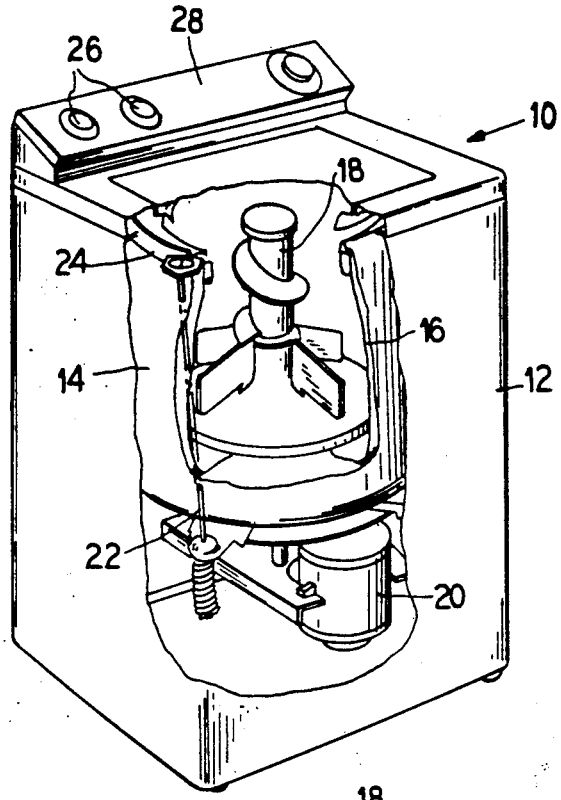
FIG. 1 is a perspective view of an automatic washer embodying the principles of the present invention.

In FIG. 1 there is illustrated an automatic washer generally at 10 embodying the principles of the present invention.

The washer has an outer cabinet 12 which encloses an imperforate wash tub 14 for receiving a supply of wash liquid. Concentrically mounted within the wash tub is a wash basket 16 for receiving a load of materials to be washed and a vertical axis agitator 18. A first motor 20 is provided which is drivingly connected to the agitator 18 to drive it in an oscillatory or rotary manner and is also selectively connectable to the basket 16 to rotatingly drive it. The assembly of tubs, agitator and motor is mounted by a suspension system 22 including springs and rods to a frame 24. A plurality of controls 26 are provided on a control console 28 for automatically operating the washer through a series of washing, rinsing and drying steps.

Figure 2:
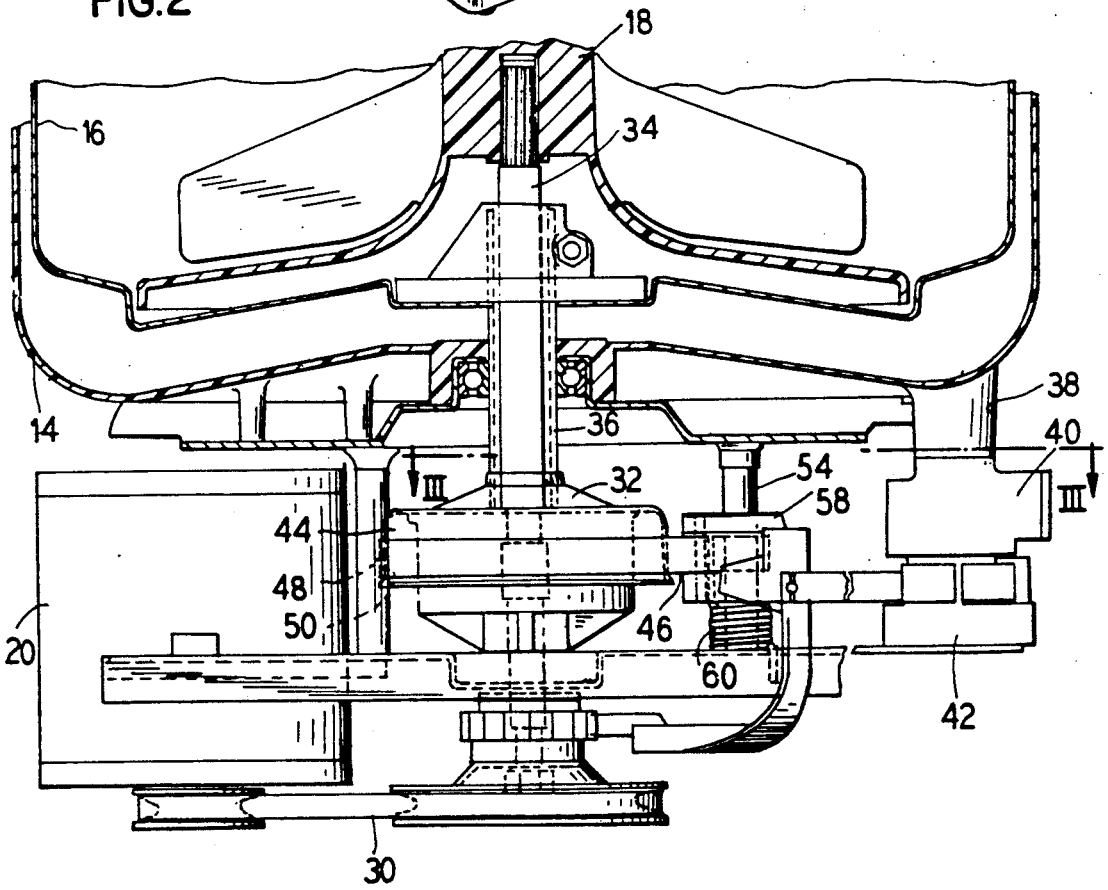
FIG. 2 is a partial side sectional view through a lower portion of an automatic washer.

The drive mechanism is shown in greater detail in FIG. 2 where it is seen that the motor 20 is connected by means of a drive belt 30 and a gear arrangement such as a planetary gear assembly 32 to a vertical shaft 34 connected to the agitator 18. The wash basket 16 is connected via a spin tube 36 to the gear arrangement 32, such as to an outer ring gear having an external hub surface 44, to provide the selective rotating drive to the basket.

The wash tub 14 has a discharge sump 38 which is connected to an input of a discharge pump 40 driven by means of a separate, second motor 42. This second motor 42 is energized at selected portions of the wash cycle when it is desired to empty wash liquid from the wash tub.

During most portions of the wash cycle it is desirable to prevent the basket 16 from rotating while in other portions of the wash cycle it is desirable to have the wash basket rotate. A basket brake 46 in the form of a band 48 surrounding the external hub surface 44 is provided wherein the band 48 has an inner surface 50 with a high friction material so as to provide adequate griping of the external hub surface 44 when the brake is engaged.

Figure 3:
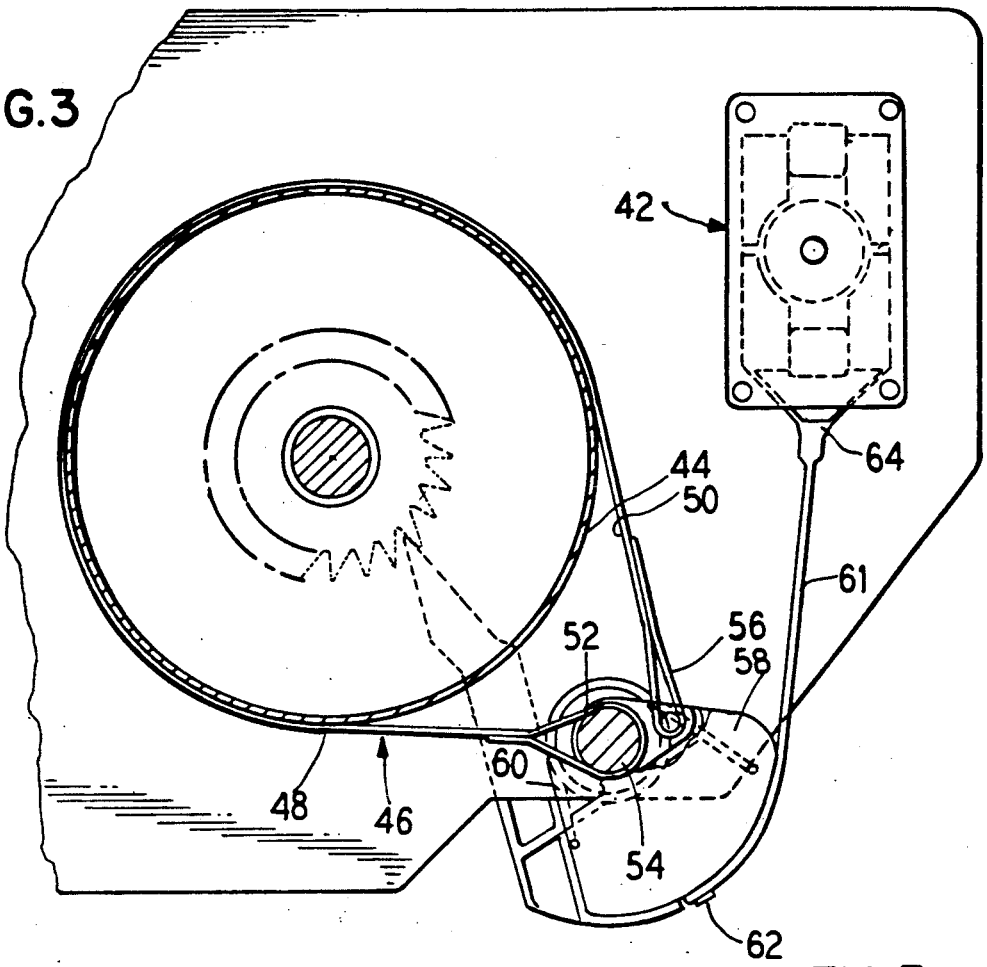
FIG. 3 is a sectional view taken generally along the line III—III of FIG. 2.

As best seen in FIG. 3, the band 48 has a first end 52 which is looped around or attached to a stationary post 54. A second end 56 is pivotably attached to a cam 58 which in turn is pivotably carried on the post 54 and is biased in a clockwise direction as seen in FIG. 3 by a spring 60 carried on the post. This biasing keeps a continuous tension on the band 48 thus keeping the band 48 in close engagement with the external hub surface 44 thereby effecting braking action between the band and the hub surface. In order to release the brake, the cam 58 must be rotated in a counterclockwise direction as viewed in FIG. 3. To provide such counterclockwise rotation of the cam, and thus to actuate the brake an actuator means in the form of a connecting strap 61 is secured at a first end 62 to the cam 58 and at a second end 64 to a displaceable stator portion of the second motor 42.

Figure 4:
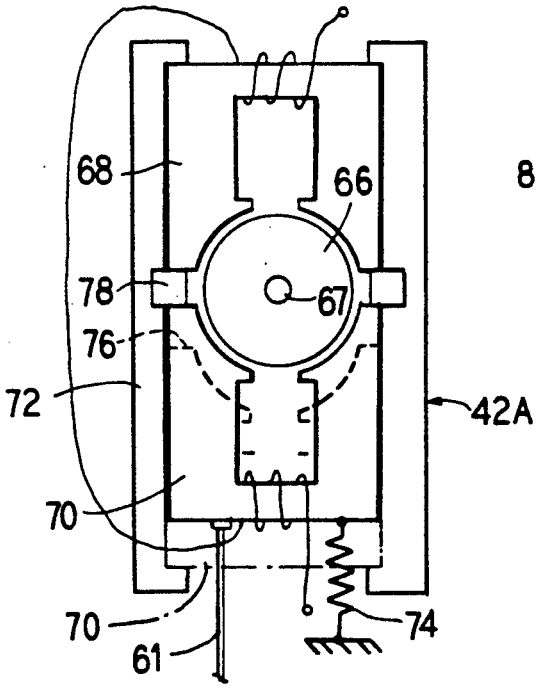
FIG. 4 is a schematic illustration of a first embodiment of the invention.

A first embodiment of such a motor is illustrated in greater detail in FIG. 4 where it is seen that a motor 42A has a central rotor 66 having a generally cylindrical shape rotatable about a central axis 67 and is closely surrounded by two separate curved arm portions 68, 70 of a stator. One of the arm portions 70 is displaceable within a housing 72 of the motor such that it can linearly slide perpendicularly away from the rotor 66 along a radial line from the axis 67. A spring 74 is schematically illustrated as applying a biasing force to the displaceable stator arm portion 70 to cause it to move into a displaced position shown in phantom. The strap 61 is schematically illustrated as also being connected to the displaceable stator arm portion 70. When the motor is placed in the arrangement as illustrated in FIG. 3, the schematically illustrated spring 74 of FIG. 4 is in fact the spring 60 which biases the cam 58 in the clockwise direction. This spring force is transmitted through the linkage means comprising the cam 58 and the strap 61.

When the motor 42A is energized, attractive magnetic forces cause the displaceable stator arm portion 70 to slide radially toward the rotor 66 until a forward end 76 of the stator portion abuts against a stop block 78. The attractive magnetic forces are sufficient to overcome the force of spring 60, thereby causing the cam 58 to rotate in a counterclockwise direction and thereby releasing the braking action of the brake band 48 on the external hub surface 44. Therefore, the displaceable stator arm portion 70 through an actuator represented by the strap 61 produces a force external of the motor 42 to overcome the force of spring 60.

It is desirable to drive the wash basket 16 in a rotating manner during portions of the wash cycle in which the wash water is pumped from the tub 14. Thus, when the pump 40 is driven by the second motor 42, it is desirable to release the basket brake. This will automatically occur when the second motor 42 is energized. In all other portions of the wash cycle it is desirable for the wash basket to be held stationary relative to the tub and, with the motor 42 deenergized, the spring 60 will bias the band 48 into a braking position.

Figure 5:
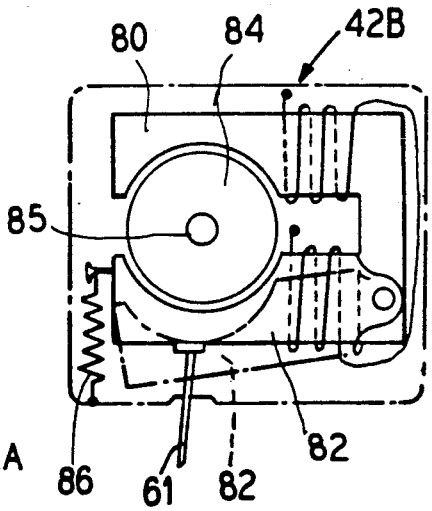
FIG. 5 is a schematic illustration of a motor incorporating a second embodiment of the invention.

An alternative embodiment of the invention is illustrated in FIG. 5 in which a motor 42B is provided with a pair of stator arm portions 80, 82 in which one of the stator arm portions 82 is pivotably displaceable away from a central rotor 84 perpendicular to an axis 85 of the rotor. Again, a spring 86 is schematically illustrated to bias the displaceable stator arm portion 82 to a position spaced away from the rotor 84 and the strap 61 is also illustrated as being attached to the displaceable stator portion. The spring 60 of FIG. 3 provides the biasing force illustrated schematically by the spring 86 in FIG. 5 through the linkage of the cam 58 and the strap 61.

As the motor 42B is energized, attractive magnetic forces will cause the displaceable stator arm portion 82 to pivot back through an arc to a position closely adjacent to the rotor 84 thereby pivoting the cam 58 in a counterclockwise direction to release the brake band 48.

It will be appreciated by those skilled in the art that movement of the stator can be used to activate or deactivate other mechanisms through a linkage means or an actuator in lieu of separate components to effect a cost savings.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

I claim:

1. A motor having a rotor rotatable about an axis and a stator surrounding said rotor wherein at least a portion of said stator is displaceable relative to said rotor from a close operating position to a spaced non-operating position and means for biasing said stator portion into said spaced non-operating position, said biasing means having a force less than an attractive magnetic force between said stator and said rotor when said motor is energized with said stator portion in said spaced non-operating position, means for automatically moving said stator portion from said spaced non-operating position to said close operating position upon energization of said motor; and an actuator means secured at one end to said movable portion of said stator and having a second end positioned external of said motor such that said actuator means is activated by movement of said stator portion to produce a mechanical force external of said motor.

2. A motor according to claim 1, wherein said stator portion is slidable relative to said rotor and moves radially with respect thereto.

3. A motor according to claim 2, wherein said stator portion is pivotably movable relative to said rotor and moves through an arc with respect thereto.

4. A motor according to claim 1, wherein said biasing means comprises a spring member.

5. A motor comprising a rotatable rotor and a stator having a fixed portion and a movable portion including means for automatically displacing said movable portion of said stator relative to said rotor upon energization of said motor from a non-operating position to an operating position, and an actuator means secured at one end to said movable portion of said stator and having a second end positioned external of said motor such that said actuator means is activated by movement of said movable stator portion to produce a mechanical force external of said motor.

6. A motor having a rotor rotatable about an axis and a stator surrounding said rotor wherein said stator has at least a portion which is automatically perpendicularly displaceable relative to said rotor from a close operating position to a spaced non-operating position upon energization of said motor and means for biasing said stator portion into said spaced non-operating position, said biasing means having a force less than an attractive magnetic force between said stator and said rotor when said motor is energized with said stator portion in said spaced position, and an actuator means secured at one end to said movable portion of said stator and having a second end positioned external of said motor such that said actuator means is activated by movement of said stator portion to produce a mechanical force external of said motor, whereby, energization of said motor will result in said stator portion moving from said spaced non-operating position to said close operating position to produce a force external of said motor.

7. A motor according to claim 6 wherein a stop means is engageable by said displaceable stator portion to prevent said displaceable stator portion from engaging said rotor.

8. A motor according to claim 6, including mans for preventing engagement of said rotor with said stator.

9. A motor according to claim 6, wherein said stator portion is slidable relative to said rotor and moves radially with respect thereto.

10. A motor comprising a rotatable rotor and a fixed stator wherein a portion of said stator is perpendicularly displaceable relative to said rotor upon energization of said motor from a non-operating position to an operating position, including an actuator means secured at one end to said movable portion of said stator and having a second end positioned external of said motor such that said actuator means is activated by movement of said stator portion to produce a mechanical force external of said motor.

* * * * *